US006241549B1

(12) United States Patent
Saka et al.

(10) Patent No.: US 6,241,549 B1
(45) Date of Patent: Jun. 5, 2001

(54) PRESSURE-CONTACT TERMINAL AND ELECTRIC CONNECTION BOX CONTAINING PRESSURE-CONTACT TERMINALS

(75) Inventors: Yuuji Saka; Nori Inoue, both of Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/453,808

(22) Filed: Dec. 3, 1999

(30) Foreign Application Priority Data

Dec. 3, 1998 (JP) ..... 10-344202

(51) Int. Cl.[7] ..... H01R 4/24; H01R 4/26; H01R 11/20

(52) U.S. Cl. ..... 439/395

(58) Field of Search ..... 439/387, 389, 439/391, 395, 418, 426, 443

(56) References Cited

U.S. PATENT DOCUMENTS 5,059,137 * 10/1991 Dale et al. ..... 439/395
5,683,266 11/1997 Guidi et al. ..... 439/395
6,000,973 * 12/1999 Mitra ..... 439/825

* cited by examiner

*Primary Examiner*—Brian Sircus
*Assistant Examiner*—Michael C. Zarroli
(74) *Attorney, Agent, or Firm*—Oliff & Berridge, PLC

(57) ABSTRACT

A pressure-contact terminal is formed by punching and bending a metal plate. A base portion has a pair of sandwiching pieces extending from it, to form a slot for accommodating an electrical cable. A pair of bent-up reinforcing portions extends along the outer edges of the sandwiching pieces. The distance between the outer faces of the reinforcing portions is substantially equal to the outer diameter of the electrical cable. A pair of coating-peeling portions projecting beyond the ends of the sandwiching pieces extend from the reinforcing portions. The gap between the coating-peeling portions is smaller than the outer diameter of the electrical cable and greater than the outer diameter of the conductor of the electrical cable. In this way a terminal of small width is obtained, permitting an electrical connection box containing such terminals to be compact.

10 Claims, 6 Drawing Sheets

PRESSURE-CONTACT TERMINAL AND ELECTRIC CONNECTION BOX CONTAINING PRESSURE-CONTACT TERMINALS

BACKGROUND OF THE INVENTION

1. Field of Invention

The present invention relates to a pressure-contact terminal which can be connected with a conductor without soldering of the conductor onto the pressure-contact terminal, and to an electric connection box including such pressure-contact terminals.

2. Description of Related Art

In a vehicle, an electric connection box having a connector holder is used to collect branch wire connection portions of a wire harness for use in electric parts and fit connectors and the like thereon. Generally, in such an electric connection box, a branch conductive circuit called a bus bar having upstanding tab portions formed by punching a metal plate such as a copper plate is fixed to an insulation plate. A circuit member having a plurality of branch conductive circuits laminated one upon another is accommodated in the body of the electric connection box. The tab portions project inside a connector socket which is formed on the body of the electric connection box.

Recently, vehicles have become equipped with more electric parts. However, since it is necessary to form the tab portions on the bus bar of the box, the electric connection box has a low degree of freedom in wiring. Thus, to construct a large circuit, it is necessary to construct the circuit member by laminating a large number of insulation plates one upon another, which leads to a large size of the electric connection box.

To solve the above-described problem, there has been proposed an electric connection box in which a part of a circuit is constructed of conductors, and pressure-contact terminals each having a tab portion and a sandwiching portion for engaging and gripping one of the conductors are used.

U.S. Pat. No. 5,683,266 shows a terminal of planar sheet metal having flexible sandwiching portions to receive an uncoated conductor wire. The terminal has a large width relative to the wire diameter, and therefore does not allow compact arrangement of multiple terminals and wire.

Thus, when a plurality of terminals are arranged beside each other in the circuit member, a dimension in the connection box corresponding to the total width of the terminals added to the total width of terminal holding portions between the terminals is required, which prevents the array of terminals from being arranged with narrow pitch. Thus, there is a limitation in producing a compact circuit member. Consequently, a small electric connection box cannot be manufactured.

SUMMARY OF THE INVENTION

In view of the above-described problems, it is an object of the present invention to provide a pressure-contact terminal which makes possible good electric connection between a conductor of an electrical cable and the pressure-contact terminal and permits a plurality of the terminals to be arranged in an array with narrow pitch, i.e., at small intervals, in an electrical connection box.

It is another object of the present invention to provide a compact electric connection box.

According to the invention there is provided a pressure-contact terminal formed by punching and bending a metal plate, having a substrate portion and a pair of sandwiching pieces extending in a first direction from the substrate portion and being spaced apart to define between them a slot that receives a conductor, which may, for example, be a single-core wire. A tab portion extends from the substrate portion in a second direction, which may be opposite to the first direction, or may be for example at a right angle to the first direction. A pair of reinforcing portions which face each other and which respectively extend alongside the sandwiching pieces are respectively joined to the sandwiching pieces at bend lines of the metal plate that extend in the first direction. The reinforcing portions support the sandwiching pieces against bending forces applied by the conductor in use of the pressure-contact terminal. A pair of coating-peeling portions are provided that peel a coating from the conductor as the conductor is engaged with the pressure-contact terminal. The coating-peeling portions extend respectively from the reinforcing portions and are more remote from the substrate portion than the sandwiching pieces.

In use of the pressure-contact terminal, the spacing distance of the outer faces of the reinforcing portions is preferably substantially equal to the outer diameter of a conductor to which the pressure-contact terminal is connected.

In the pressure-contact terminal of the invention, a cut-out, e.g., a rectangular cut-out, is preferably formed between each reinforcing portion and the corresponding coating-peeling portion. The cut-out is located at the bend-line of the reinforcing portion and the sandwiching portion.

Preferably, the spacing between the pair of coating-peeling portions is smaller than the outer diameter of an electrical cable containing the conductor and greater than or equal to the outer diameter of the conductor.

The invention also provides an electric connection box containing a plurality of the pressure-contact terminals installed in the body of the electric connection box, e.g., in an array at regular intervals, such that reinforcing portions of the respective pressure-contact terminals are opposed to each other, with the pressure-contact terminals electrically and mechanically connected with a plurality of conductors inside the body of the electric connection box.

BRIEF DESCRIPTION OF THE DRAWINGS

An embodiment of the invention will now be described by way of non-limitative example with reference to the accompanying drawings, in which.

DETAILED DESCRIPTION OF PREFERRED EMBODIMENTS

Embodiments of the present invention will be described below with reference to FIGS. 1 to 6.

Figure 3:
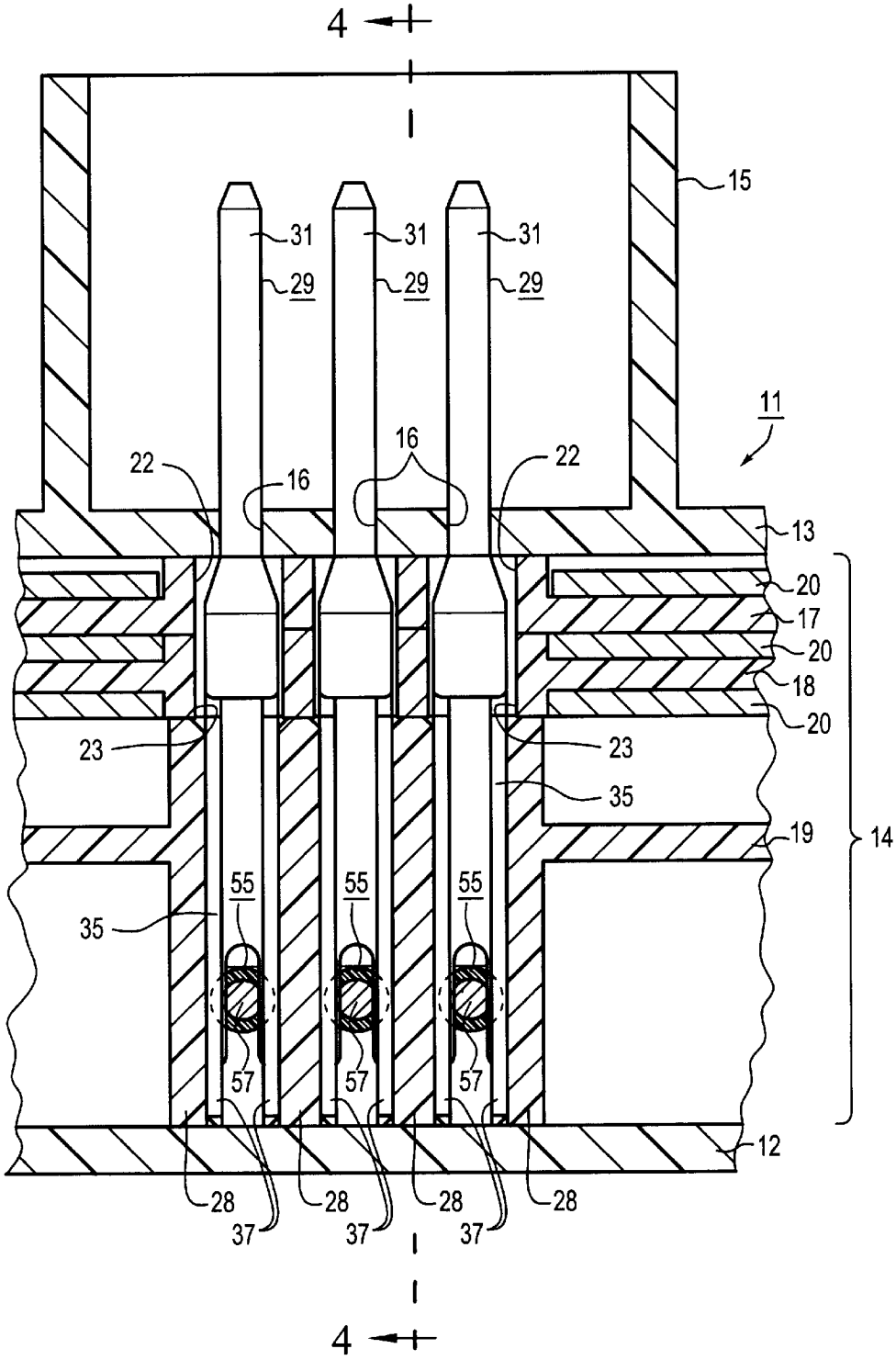
FIG. 3 is a partial sectional view of an electric connection box comprising several of the pressure-contact terminals shown in FIG. 1.
Figure 4:
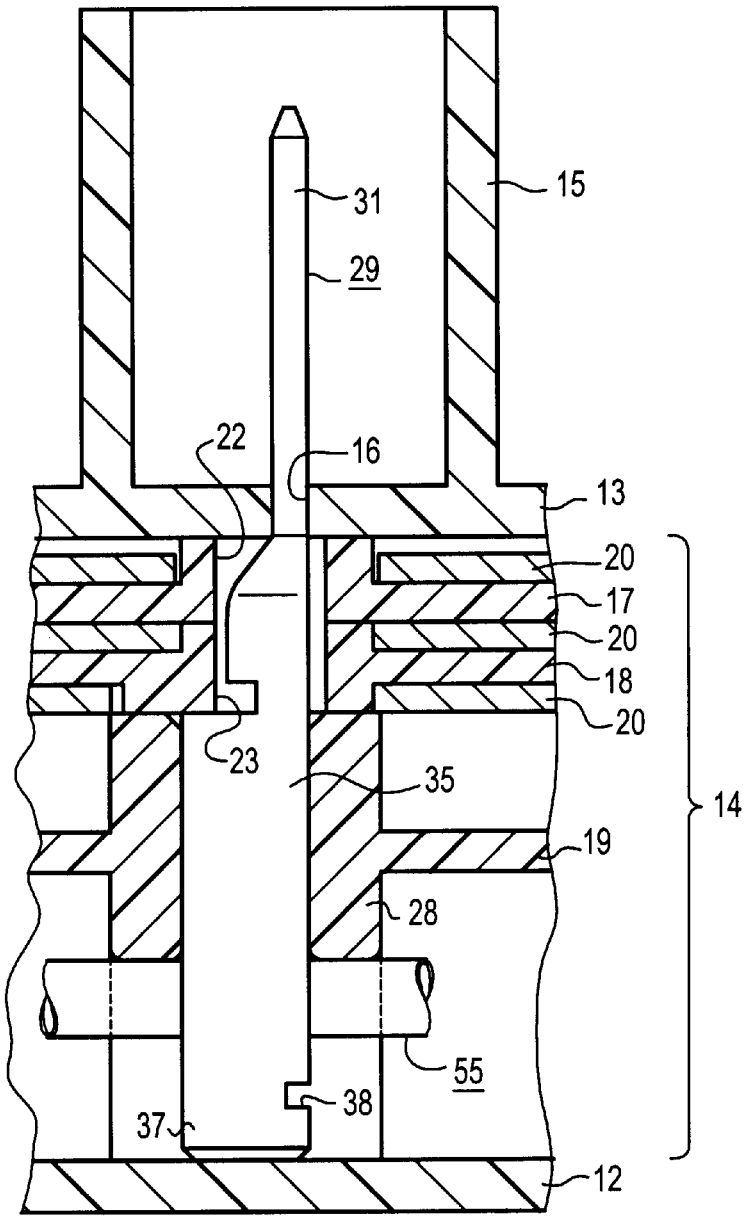
FIG. 4 is a partial sectional view of the electrical connection box along the line A—A of FIG. 3.

As shown in FIG. 3, an electric connection box 11 includes a lower case 12, an upper case 13, and a circuit member 14. The lower case 12 and the upper case 13 are formed of moulded synthetic resin, and constitute the body of the electric connection box 11. The lower case 12 and the upper case 13 are locked together at locking portions (not shown) in a conventional manner, with the lower case 12 and the upper case 13 fitted on each other.

A rectangular cylindrical connector socket 15 is formed as an integral part of the upper case 13. The connector socket 15 in use fits with a connector (not shown) of an external circuit. A plurality of through-holes 16 is formed in the base of the connector socket 15 at regular intervals.

The circuit member 14 is constructed of a plurality of insulation plates 17–19 stacked one upon another. Bus bars 20 each having a predetermined circuit pattern are mounted on the upper insulation plates 17, 18. Insertion holes 22, 23 are formed in the insulation plates 17, 18 at positions corresponding to the through-hole 16. The respective insertion holes 22, 23 communicate with each other.

A plurality of electrical cables 55, which may, for example, be single-core wires, and which may constitute parts of one or more circuits, are roated next to the insulation plate 19. In correspondence to the insertion holes 22, 23, a plurality of holding portions 28 are formed on the lowermost insulation plate 19. A plurality of pressure-contact terminals 29 (hereinafter referred to merely as terminals) are disposed between adjacent pairs of the holding portions 28 and in the holes 22, 23. Each terminal 29 is connected to the conductor 57 of one of the electrical cables 55. Tab portions 31 of the terminals 29 project through the through-holes 16. Thus, when the lower case 12 and the upper case 13 are fitted on each other, with the circuit member 14 accommodated in the lower case 12 and the upper case 13, the tab portion 31 of each terminal 29 projects inside the connector socket 15.

As shown in FIG. 1, each terminal 29 is formed by punching out and shaping a metal plate (sheet). A narrow tab portion 31 extends from one end of a planar substrate portion 30 which has a larger width than the tab portion 31. The tab portion 31 is formed by folding together a pair of tab-forming pieces 31A, 31B into close contact with each other. The tab portion 31 thus has a double thickness. The piece 31A is coplanar with the substrate portion 30, while the piece 31B is in a parallel plane.

From the other end of the substrate portion 30, a pair of narrow sandwiching pieces 32, which are coplanar with the substrate portion 30, extend in the direction opposite to the extension direction of the tab portion 31. In alternative embodiments, the sandwiching pieces 32 and tab portion 31 may extend at right angles to each other. A slot 33 for receiving the electrical cable 55 is formed between the two sandwiching pieces 32. At an inner side of a front (lower) end of each sandwiching piece 32, there is formed an oblique guide portion 34. These guide portions 34 cooperate to guide the conductor 57 into the slot 33, and assist in peeling off the insulating coating 56 of the electrical cable 55.

Figure 1A:
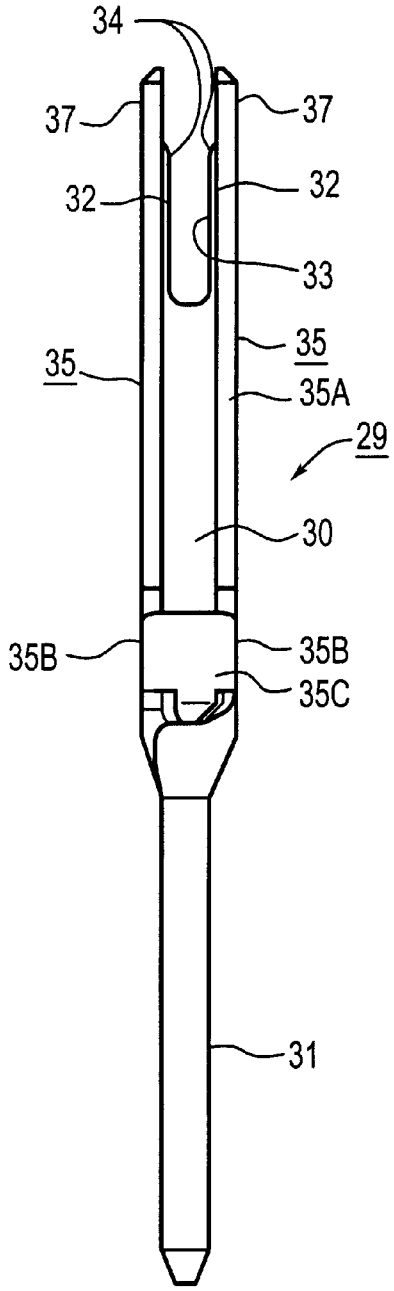
FIG. 1A is a front view of a pressure-contact terminal which is an embodiment of the present invention.
Figure 1B:
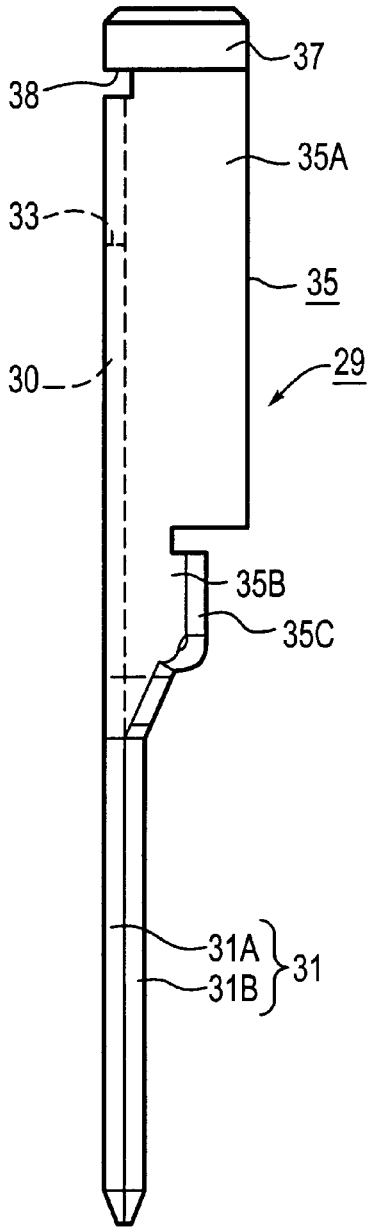
FIG. 1B is a side view of the pressure-contact terminal shown in FIG. 1A.
Figure 6:
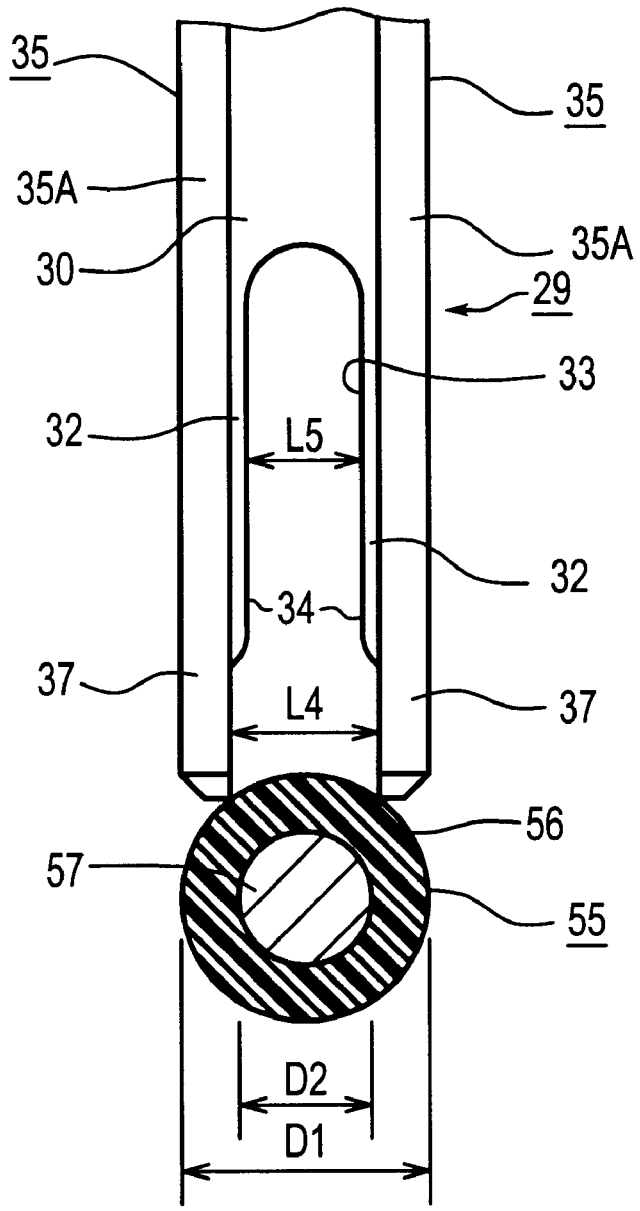
FIG. 6 is an enlarged view of a portion of the pressure-contact terminal shown in FIG. 1.

A pair of reinforcing portions 35 extending alongside the sandwiching pieces 32 and the substrate portion 30 are formed at the lateral edges thereof by bending the material of the plate to an angle substantially perpendicular to the sandwiching pieces 32 and the substrate portion 30. As shown in FIG. 1B, each reinforcing portion 35 is stepped at a position along the length of the substrate portion 30 to form an upper wide region 35A and a lower narrow region 35B. As shown in FIG. 1A and FIG. 6, in the region of the sandwiching piece 32 and the substrate portion 30, the gap between outside faces of the wide regions 35A of the reinforcing portions 35 is almost equal to the outer diameter of the electrical cable 55. The gap between the outside faces of the narrow regions 35B is also almost equal to the outer diameter of the electrical cable 55 at an upper part of the narrow regions 35B and is gradually reduced downwardly, thus becoming equal to the width of the tab portion 31 at the junction with the tab portion 31. The wide regions 35A of the reinforcing portions 35 reinforce both the sandwiching pieces 32 and the substrate portion 30, so that the terminal applies a predetermined contact pressure to the electrical cable 55 when the electrical cable 55 is connected to the sandwiching pieces 32. The narrow regions 35B of the reinforcing portions 35 reinforce the substrate portion 30. A shielding portion 35C joined integrally with one of the narrow portions 35B is bent toward the other narrow portion 35B to shield the space between the two narrow portions 35B.

As seen in FIG. 1, a pair of coating-peeling portions 37 extend upwardly from the upper ends of the wide regions 35A of the reinforcing portions 35 beyond the upper ends of the sandwiching pieces 32. A rectangular cut-out 38 is formed between the wide region 35A and the coating-peeling portion 37 such that the cut-out is at the location of the plane of the sandwiching pieces 32, i.e., at the location of the bend-line at which a reinforcing portion 35 joins a respective sandwiching piece 32. The provision of the cut-out 38 prevents formation of a curved portion at an end of the coating-peeling portion 37 when the material corresponding to the reinforcing portion 35 is bent and allows the upper edges of the two coating-peeling portions 37 to be parallel with each other. The tip ends of the coating-peeling portions 37 taper. As shown in FIG. 1 A, but not in other figures, the tip end parts of the coating peeling portions 37 are optionally slightly bent towards each other. The gap between them, however, should be less than the outer diameter of the whole electrical cable and greater than the conductor diameter.

As shown in FIG. 6, the gap L4 between the inside faces of the coating-peeling portions 37 is smaller than the outer diameter D1 of the electrical cable 55 and greater than the outer diameter D2 of the conductor 57.

Figure 2:
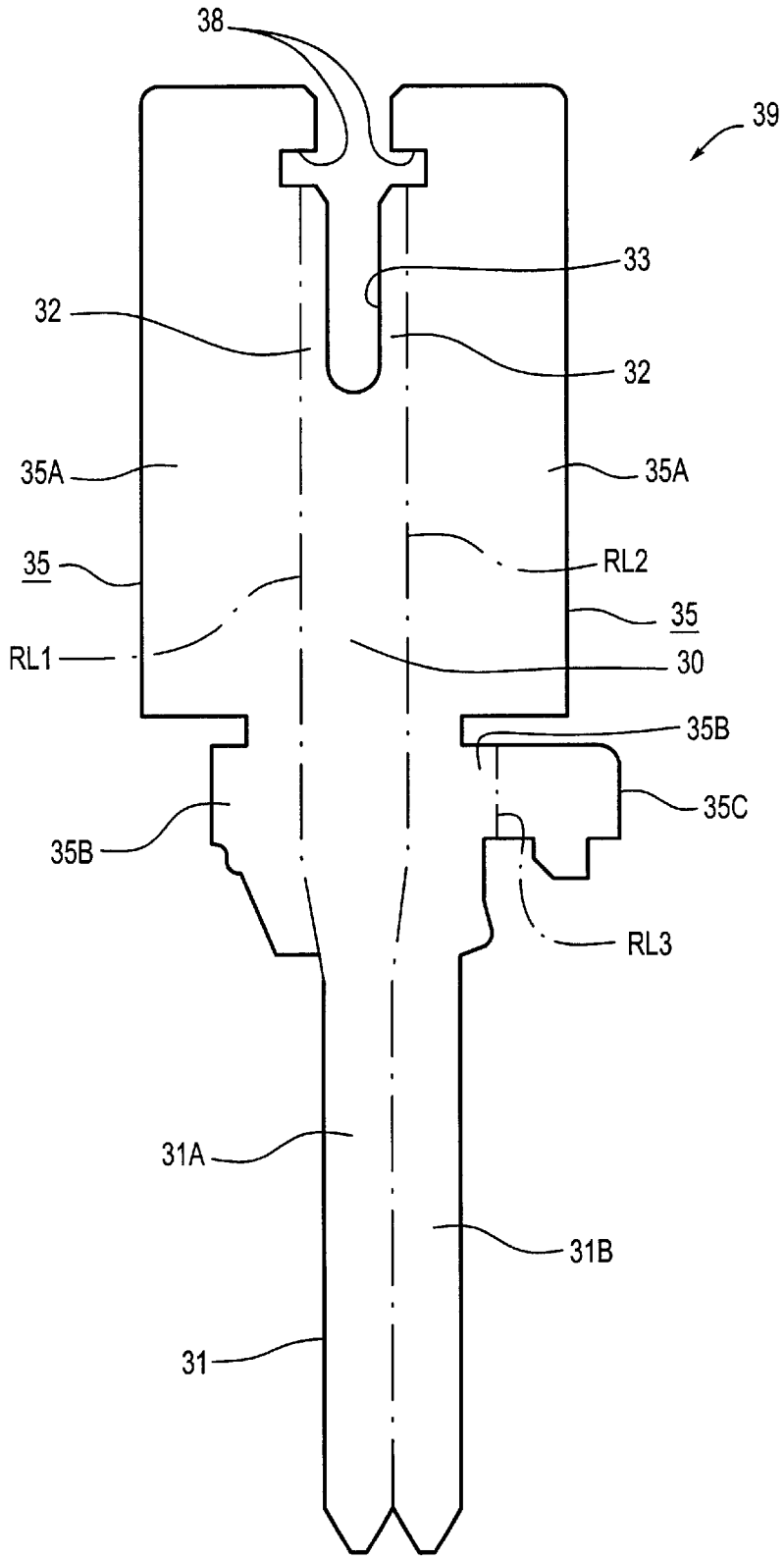
FIG. 2 is a developed view of the pressure-contact terminal shown in FIG. 1.

FIG. 2 is a developed pattern 39 for forming the terminal 29. The developed pattern 39 is formed in its planar state by punching a metal plate with a pressing tool.

Initially, by bending the developed pattern 39 at 90° along lines RL1, RL2, the reinforcing portions 35 are formed at both edges of the substrate portion 30 and at the outer edges of the sandwiching pieces 32. At this time, the tab-forming pieces 31A, 31B are formed at right angles to each other. Then, along the line RL2 at the portion corresponding to the tab portion 31, the tab-forming pieces 31A, 31B are folded further by 90° such that they contact each other closely. In this manner, the tab portion 31 is formed. In forming the tab portion 31, the portion of the developed pattern 39 corresponding to the shielding portion 35C is bent at 90° along the line RL3 to form the shielding portion 35C which shields the space between the narrow regions 35B of the reinforcing portions 35.

With reference to FIGS. 5A–5D, the method of connecting the terminal 29 and the electrical cable 55 with each other will now be described.

Figures 5A, 5B, 5C, 5D:
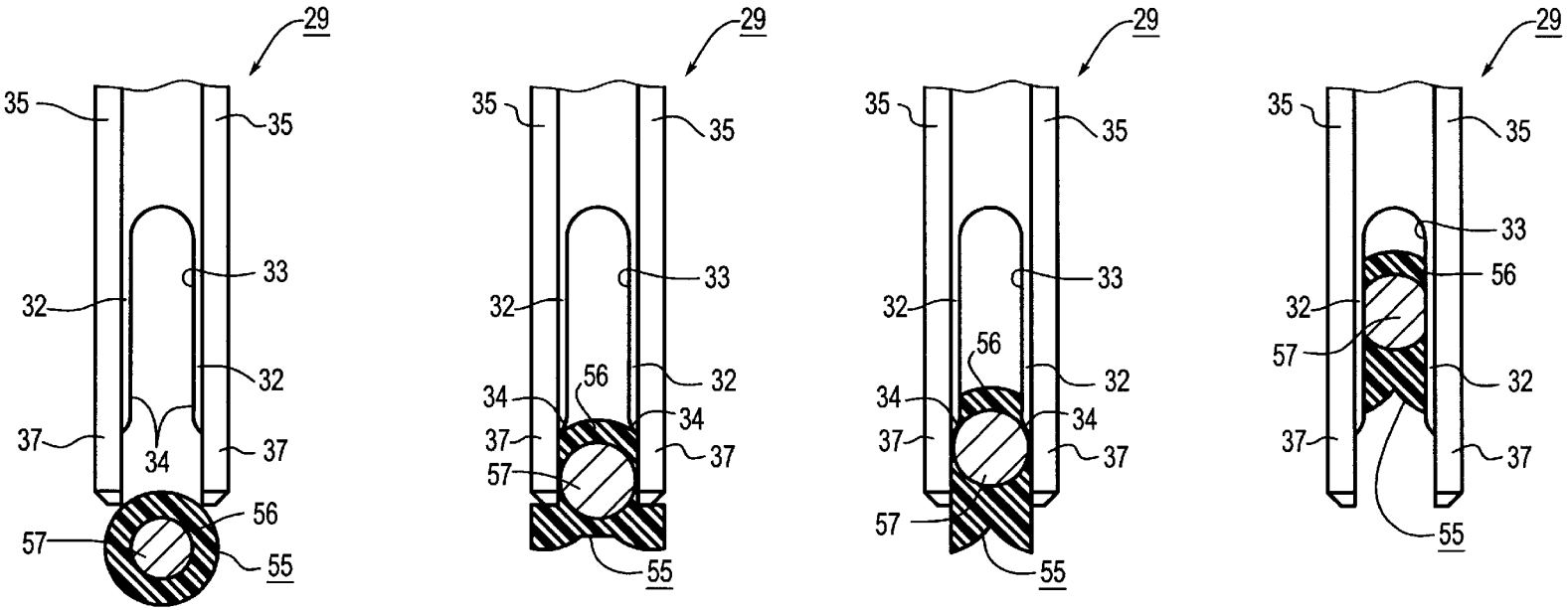
FIGS. 5A to 5D are a series of explanatory views showing the formation of a connection between an electrical cable and the pressure-contact terminal shown in FIG. 1.

Initially, as shown in FIG. 5A, the electrical cable 55 is placed between the coating-peeling portions 37 of the terminal 29 and is then pressed by a jig (not shown). As a result, the inner edge of the coating-peeling portion 37 breaks the insulating coating 56, thus starting to peel off the insulating coating 56 from the conductor 57.

Then, as shown in FIG. 5B, as the electrical cable 55 located between the two coating-peeling portions 37 is advanced toward the slot 33, the coating-peeling portions 37 peel off a part of the periphery of the insulating coating 56 to positions close to the conductor 57. The oblique guide portions 34 then peel off the insulating coating 56 as far as the peripheral surface of the conductor 57.

Then, as shown in FIG. 5C, as the electrical cable 55 is advanced further into the slot 33, the inner ends (upper ends in FIG. 5C) of the oblique guide portions 34 start to cut the peripheral surface of the conductor 57.

As shown in FIG. 5D, as the electrical cable 55 is advanced yet further into the slot 33, the inner ends of the oblique guide portions 34 cut off, or cut into, a part of the peripheral surface of the conductor 57. As a result, the electrical cable 55 and the terminal 29 are electrically connected with each other. At this time, the reinforcing portions 35 impart a predetermined contact pressure to the sandwiching pieces 32 and the conductor 57. Thus, a good electrical contact is obtained therebetween, and the mechanical fixing of the wire 55 is strong and durable.

In this embodiment the metal sheet thickness is 0.3 mm, which is considerably less than the typical thickness of 0.64 mm used for prior art terminals. Nevertheless, the double sheet thickness of the tab portion 31 is about the same as in the prior art. The total weight of the terminal is less than that of the prior art terminal. Suitable metals having high strength for use in the terminal of the invention are known, such as Cu-based metal including additionally any one of Fe, Mg and Ni. In the invention the sheet thickness is preferably not more than 0.5 mm, more preferably not more than 0.4 mm.

An embodiment having the above-described construction has the following effects:

(1) The pair of reinforcing portions 35 formed at the edges of each of the sandwiching pieces 32 imparts a predetermined contact pressure to the sandwiching pieces 32 and the conductor 57. Thus, a good electrical contact is obtained between the terminal 29 and the electrical cable 55.

(2) The outer edges of the sandwiching pieces 32 join the reinforcing portions 35 by bend-lines, and the distance between the outer faces of two reinforcing portions 35 is almost equal to the outer diameter of the electrical cable 55. Thus, it is possible to make the width of the terminal 29 almost equal to the outer diameter of the electrical cable 55. Accordingly, in constructing the circuit member 14, the terminals 29 can be arranged at narrow pitch, i.e., at small intervals. That is, it is possible to form a compact circuit member 14. Therefore, it is possible to form a compact electric connection box 11 accommodating the compact circuit member 14.

(3) The pair of coating-peeling portions 37 extends (upward in FIG. 1; downward in FIG. 5) from the reinforcing portion 35 such that the coating-peeling portions 37 are lower (in FIG. 5) than the lower end of each of the sandwiching pieces 32. Accordingly, the coating-peeling portions 37 peel off the insulating coating 56 of the electrical cable 55 when the terminal 29 and the electrical cable 55 are connected together.

(4) The gap between the pair of coating-peeling portions 37 is smaller than the outer diameter of the electrical cable 55 and greater than the outer diameter of the conductor 57. Thus, it is possible initially to peel off a part of the insulating coating 56 of the electrical cable 55 when connecting the terminal 29 and the electrical cable 55 with each other.

(5) The rectangular cut-out 38 is formed between the reinforcing portion 35 and the coating-peeling portion 37 such that the cut-out 38 is located adjacent the bend of the reinforcing portion 35. The formation of the cut-out 38 prevents a curved portion from being formed at the end of the coating-peeling portion 37 when the reinforcing portion 35 is bent and allows the upper edges of the coating-peeling portions 37 to be parallel with each other. Accordingly, the coating-peeling portions 37 peel off the insulating coating 56 of the electrical cable 55 uniformly over its whole length.

(6) The oblique guide portions 34 formed at the upper ends of the sandwiching portions 32 peel off the insulating coating 56 of the electrical cable 55 as far as the peripheral surface of the conductor 57. That is, the oblique guide portions 34 guide the conductor 57 into the slot 33 while they are cutting off, or cutting into, a part of the peripheral surface of the conductor 57.

(7) The reinforcing portions 35 are formed alongside the sandwiching pieces 32 and the substrate portion 30. Thus, it is possible to achieve good mechanical strength of the terminal 29.

(8) The tab portion 31 is formed by folding the pair of tab-forming pieces 31A, 31B, to lie in close contact with each other. Therefore, it is possible to achieve the desired mechanical strength of the tab portion 31 even if the terminal 29 is formed of a thin metal plate. Thus, the terminal 29 can be lightweight and produced at low cost.

(9) The terminal 29 has the shielding portion 35C formed thereon to shield the space between the two narrow regions 35B of the reinforcing portion 35. Thus, when handling a plurality of the terminals 29, it is possible to prevent the tab portion 31 from entering into the space between the narrow regions 35B of another terminal 29 and thus reduce the risk of deformation of the terminal 29.

The embodiment may be modified as described below.

In the embodiment, the rectangular cut-out 38 is formed between the reinforcing portion 35 of the terminal 29 and the coating-peeling portion 37 thereof. But a cut-out of any desired shape may be formed therebetween. The operation and effect of the modified cut-out are the same as those of the embodiment.

In summary, by the invention it is possible to obtain an excellent electric connection between the coated single-core wire and the pressure-contact terminal, while adjacent terminals can be arranged with small pitch, i.e., adjacent wires can be close. In consequence it is possible to obtain a compact electric connection box.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. A pressure-contact terminal, comprising:

(a) a base portion;

(b) a pair of sandwiching pieces extending in a first direction from said base portion and spaced apart to define between them a slot that receives a conductor;

(c) a tab portion extending from said base portion in a second direction;

(d) a pair of reinforcing portions which face each other and respectively extend alongside said sandwiching pieces, being respectively joined to said sandwiching pieces at bend lines of said metal plate extending in said first direction, said reinforcing portions supporting said sandwiching pieces against bending forces applied to said sandwiching pieces by said conductor; and (e) a pair of coating-peeling portions that peel at least a portion of a coating from said conductor as said conductor is engaged with the pressure-contact terminal, said coating-peeling portions extending respectively from said reinforcing portions and being substantially perpendicular to said base portion and being more remote from said base portion than said sandwiching pieces.

2. A pressure-contact terminal, comprising:

(a) a base portion;

(b) a pair of sandwiching pieces extending in a first direction from said base portion and spaced apart to define between them a slot that receives a conductor;

(c) a tab portion extending from said base portion in a second direction;

(d) a pair of reinforcing portions which face each other and respectively extend alongside said sandwiching pieces, being respectively joined to said sandwiching pieces at bend lines of said metal plate extending in said first direction, said reinforcing portions supporting said sandwiching pieces against bending forces applied to said sandwiching pieces by said conductor;

(e) a pair of coating-peeling portions that peel at least a portion of a coating from said conductor as said conductor is engaged with the pressure-contact terminal, said coating-peeling portions extending respectively from said reinforcing portions and being substantially perpendicular to said base portion and being more remote from said base portion than said sandwiching pieces; and (f) cut-outs located at said bend lines at points where said reinforcing portions join respective said coating-peeling portions.

3. An assembly comprising:

(I) a pressure-contact terminal, comprising:

(a) a base portion;

(b) a pair of sandwiching pieces extending in a first direction from said base portion and spaced apart to define between them a slot that receives a conductor;

(c) a tab portion extending from said base portion in a second direction;

(d) a pair of reinforcing portions which face each other and respectively extend alongside said sandwiching pieces, being respectively joined to said sandwiching pieces at bend lines of said metal plate extending in said first direction, said reinforcing portions supporting said sandwiching pieces against bending forces applied to said sandwiching pieces by said conductor; and (e) a pair of coating-peeling portions that peel at least a portion of a coating from said conductor as said conductor is engaged with the pressure-contact terminal, said coating-peeling portions extending respectively from said reinforcing portions and being substantially perpendicular to said base portion, and being more remote from said base portion than said sandwiching pieces; and (II) a conductor having an insulating coating, pressed into said slot between said sandwiching pieces so that said conductor is electrically connected to said pressure-contact terminal;

wherein respective outer faces of said pair of reinforcing portions of said pressure-contact terminal are mutually spaced by a distance which is substantially equal to an outer diameter of said insulating coating.

4. An assembly according to claim 3, wherein said pair of coating-peeling portions of said pressure-contact terminal are mutually spaced by a distance which is less than said outer diameter of said insulating coating and greater than or equal to an outer diameter of said conductor.

5. An electrical connection box comprising:

(I) a body;

(II) a plurality of pressure-contact terminals mounted in said body, each said pressure contact terminal comprising:

(a) a base portion;

(b) a pair of sandwiching pieces extending in a first direction from said base portion and spaced apart to define between them a slot that receives a conductor;

(c) a tab portion extending from said base portion in a second direction;

(d) a pair of reinforcing portions which face each other and respectively extend alongside said sandwiching pieces, being respectively joined to said sandwiching pieces at bend lines of said metal plate extending in said first direction, said reinforcing portions supporting said sandwiching pieces against bending forces applied to said sandwiching pieces by said conductor; and (e) a pair of coating-peeling portions that peel at least a portion of a coating from said conductor as said conductor is engaged with the pressure-contact terminal, said coating-peeling portions extending respectively from said reinforcing portions and being substantially perpendicular to said base portion, and being more remote from said base portion than said sandwiching pieces;

said pressure-contact terminals being mounted in said body adjacent one another; and (III) a plurality of conductors mounted in said body and connected to respective said pressure-contact terminals by insertion into said slots.

6. A pressure-contact terminal according to claim 1, wherein said coating-peeling portions are bent towards each other.

7. A pressure-contact terminal according to claim 1, wherein said pair of coating-peeling portions of said pressure-contact terminal are mutually spaced by a distance which is less than an outer diameter of said coating and greater than or equal to an outer diameter of said conductor.

8. An assembly according to claim 3, wherein said coating-peeling portions are bent towards each other.

9. An electrical connection box according to claim 5, wherein said coating-peeling portions are bent towards each other.

10. An electrical connection box according to claim 5, wherein said pair of coating-peeling portions of said pressure-contact terminal are mutually spaced by a distance which is less than an outer diameter of said coating and greater than or equal to an outer diameter of said conductor.

* * * * *